United States Patent [19]

DeRoss

[11] 4,160,574

[45] Jul. 10, 1979

[54] CONNECTOR FOR FLAT WIRE CABLES HAVING IMPROVED CONTACTS AND INTEGRAL STRAIN RELIEF MEANS

[75] Inventor: Robert W. DeRoss, Cicero, Ill.

[73] Assignee: Bunker Ramo Corporation, Oak Brook, Ill.

[21] Appl. No.: 855,636

[22] Filed: Nov. 29, 1977

Related U.S. Application Data

[63] Continuation-in-part of Ser. No. 786,342, Apr. 11, 1977, abandoned.

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,355,699 | 11/1967 | Oshva | 339/99 R |
| 3,397,380 | 8/1968 | Puig | 339/99 R |
| 3,405,385 | 10/1968 | Rapp | 339/97 R |
| 3,599,172 | 8/1971 | Tuchto | 339/98 |
| 3,760,331 | 9/1973 | Gurley | 339/97 P |
| 3,955,873 | 5/1976 | Peterson | 339/99 R |

*Primary Examiner*—Joseph H. McGlynn
*Attorney, Agent, or Firm*—William Lohff; F. M. Arbuckle

[57] ABSTRACT

A connector for making intimate electrical contact with plural insulated conductors of a flat wire cable which includes plural contacts each having a pair of spaced-apart jaw members with insulation piercing and electrical contact portions extending substantially parallel to and on opposite sides of the axis of an associated conductor. Slots in an inner body portion of the connector hold the contacts in two laterally spaced rows on opposite sides of a central cavity. A rigid bar member inserted into the cavity forces the conductors into engagement with the contacts in both rows to first pierce and continuously strip the insulation adjacent a longitudinal portion of each conductor and then position the stripped conductor adjacent the contact portions which thereafter exert a force normal to and make broad flat surface contact with the conductors.

In a preferred form, the inner body portion of the connector is received in an outer body portion which includes a plurality of channels which receive extensions of the contacts so that external access is provided to both the contacts and the conductors.

30 Claims, 16 Drawing Figures

FIG. 9
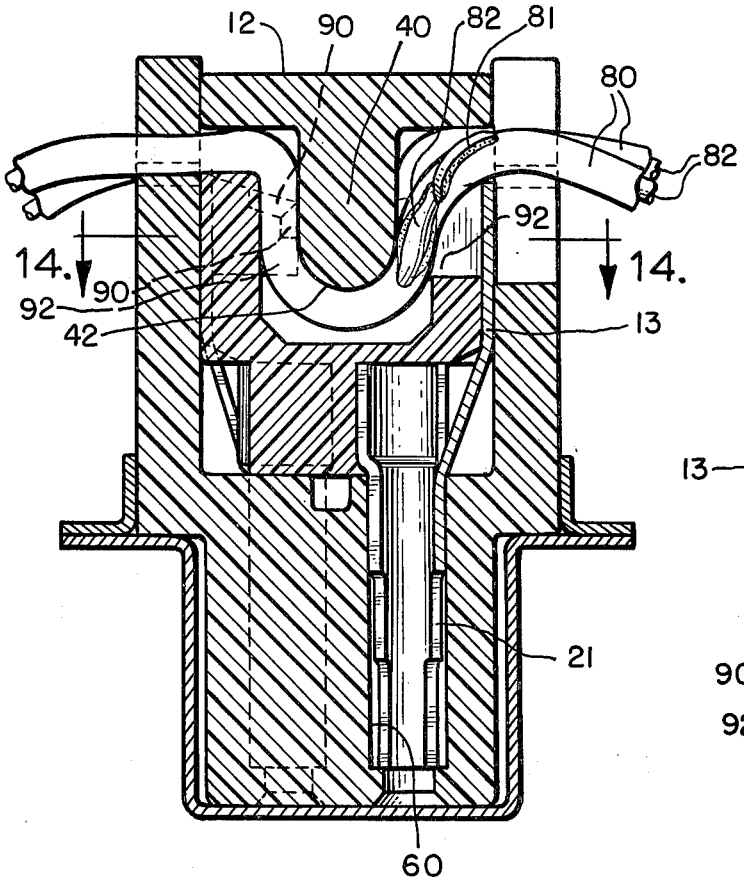
FIG. 13
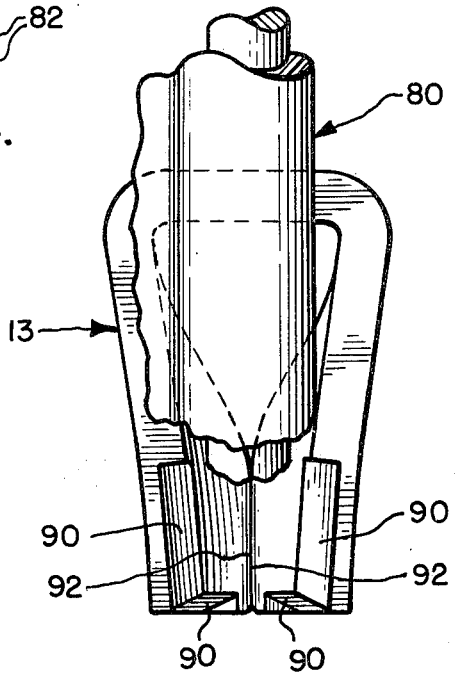
FIG. 10
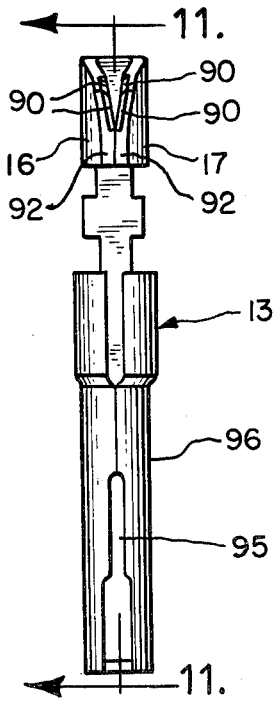
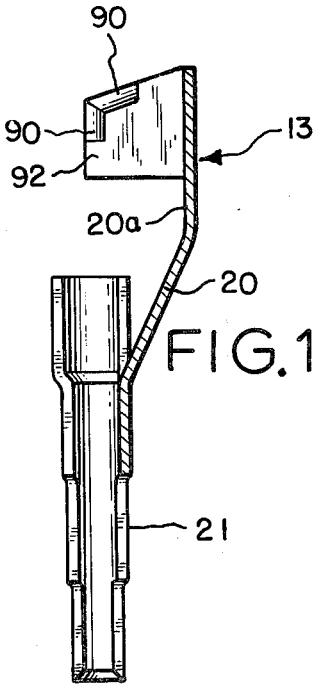
FIG. 11
FIG. 12
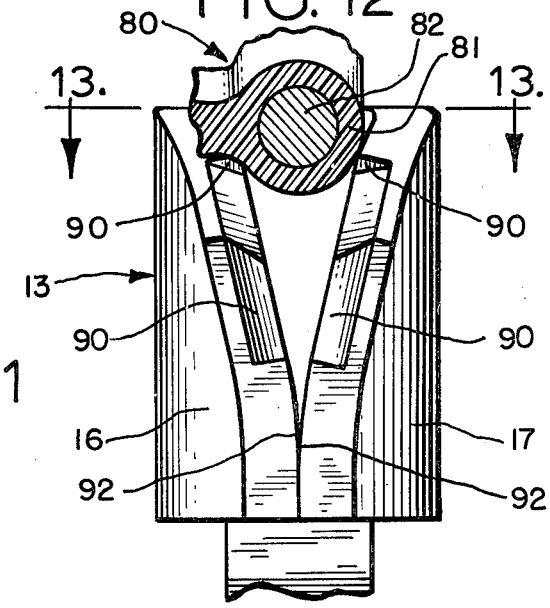

CONNECTOR FOR FLAT WIRE CABLES HAVING IMPROVED CONTACTS AND INTEGRAL STRAIN RELIEF MEANS

RELATED APPLICATION

This is a continuation-in-part application of application Ser. No. 786,342, filed Apr. 11, 1977, now abandoned.

BACKGROUND OF THE INVENTION

The present invention is generally directed to electrical connectors and, more particularly, to a new and improved electrical connector for facilitating the electrical connection of flat wire cable conductors to external terminals on printed wiring board modules or the like.

The increasing practice, particularly in sophisticated electronics fields, exemplified by the computer industry, to modularize and miniaturize electronic circuitry has provoked the problem of finding more efficient and reliable means for interconnecting the individual circuit modules. The module interconnnections should preferably be effected to facilitate module replacement or removal for servicing, yet provide consistent, low resistance paths between the modules during normal circuit operation.

One partial solution to this problem has been the introduction of flat wire cables. Such cables generally include a plurality of parallel side-by-side conductors which are insulated and spaced apart from one another by the insulating material. The insulating material is usually composed of a suitable flexible plastic, such as polyester, so that the conductors are easily routed between modules.

In an attempt to provide an intimate contact between the parallel conductors and the circuit modules, connectors have been developed which include a plurality of contacts for engaging the conductors, each contact being connected to a respective terminal for mating with complementary external terminals on the modules. The connectors developed heretofore to serve the above-mentioned function have not proved entirely satisfactory in practice. One deficiency in such prior art connectors has been their inability to provide a consistent low resistance electrical path between the conductors and the modules. It has been found that the undesirably high resistance has been the result of the connectors including contacts which pierce and contact the conductors perpendicular to the axes of the conductors. Because the contacts are relatively narrow, only limited surface contact is established between the conductors and the connector contacts of the prior art.

Another deficiency in prior art connectors has been the requirement of hardware external to the conductors to provide strain relief for the conductors. As a result, prior art connectors affording strain relief have been comprised of an exhorbitant number of individual parts making such connectors difficult to assemble and use, and unnecessarily expensive.

The invention is therefore directed to a new and improved connector for making broad intimate surface contact with a conductor to thereby provide a low resistance contact between the conductor and the electrical components to which it is connected.

The invention is further directed to a connector for making intimate contact with the conductor of an insulated conductor which pierces and strips the insulation parallel to and immediately adjacent a longitudinal portion of the conductor and which includes a contact portion which exerts a force against the base conductor normal to the conductor for making broad intimate surface contact with the conductor.

The invention is also directed to a connector for making intimate contact with each of a plurality of parallel conductors insulated from one another and which includes internal strain relief means for the conductors.

The invention is additionally directed to a connector for making broad intimate surface contact with each of a plurality of parallel conductors insulated from one another which is easy to use and which provides for the external connection of the conductors to terminals carried by printed circuit boards or the like.

SUMMARY OF THE INVENTION

The invention provides a connector for making intimate contact with the conductor of an insulated conductor which includes a contact having a piercing and stripping portion and a contact portion extending substantially parallel to the conductor, the contact being arranged to engage the insulation immediately adjacent the conductor, and pusher means for forcing the insulated conductor into engagement with the piercing portion and the contact portion. As a result, when the pusher means forces the insulated conductor into engagement with the contact, the piercing portion pierces and continuously strips the insulation parallel to and immediately adjacent a longitudinal portion of the conductor, and the contact portion exerts a force against the stripped conductor portion normal to the conductor axis for making broad intimate surface contact therewith.

The invention further provides a connector for making intimate contact with each of a plurality of parallel conductors insulated from one another which includes a plurality of contacts each having a pair of spaced-apart, partially biased jaw members extending substantially parallel to the center axes of the conductors, each side having a piercing portion and a contact portion and arranged to engage the insulation immediately adjacent the conductors, a body including means for holding the contacts, and pusher means for forcing the insulated conductors into engagement with the piercing portions and the contact portions As a result, when the pusher means forces the insulated parallel conductors into the contacts, the piercing portions pierce and continuously strip the insulation parallel to the conductors immediately adjacent longitudinal portions of the conductors, and the contact portions exert a force against the conductors normal to the conductors for making braod intimate contact therewith.

BRIEF DESCRIPTION OF THE DRAWINGS

The features of the present invention which are believed to be novel are set forth with particularity in the appended claims The invention, together with further objects and advantages thereof may best be understood by reference to the following description taken in conjunction with the accompanying drawings and in which:

FIG. 9 is a cross-sectional view taken substantially along line 9—9 of FIG. 1 illustrating an insulated conductor in an assembled relation with the connector;

FIG. 10 is a top plan view of a contact which may be used in connection with the connector of FIG. 1;

FIG. 11 is a partial cross-sectional view taken substantially along line 11—11 of FIG. 10;

FIG. 12 is a cross-section view to an enlarged scale taken substantially along line 12—12 of FIG. 9*a;*

FIG. 13 is a cross-sectional view taken substantially along line 13—13 of FIG. 12.

DESCRIPTION OF THE PREFERRED EMBODIMENTS

Figure 4:
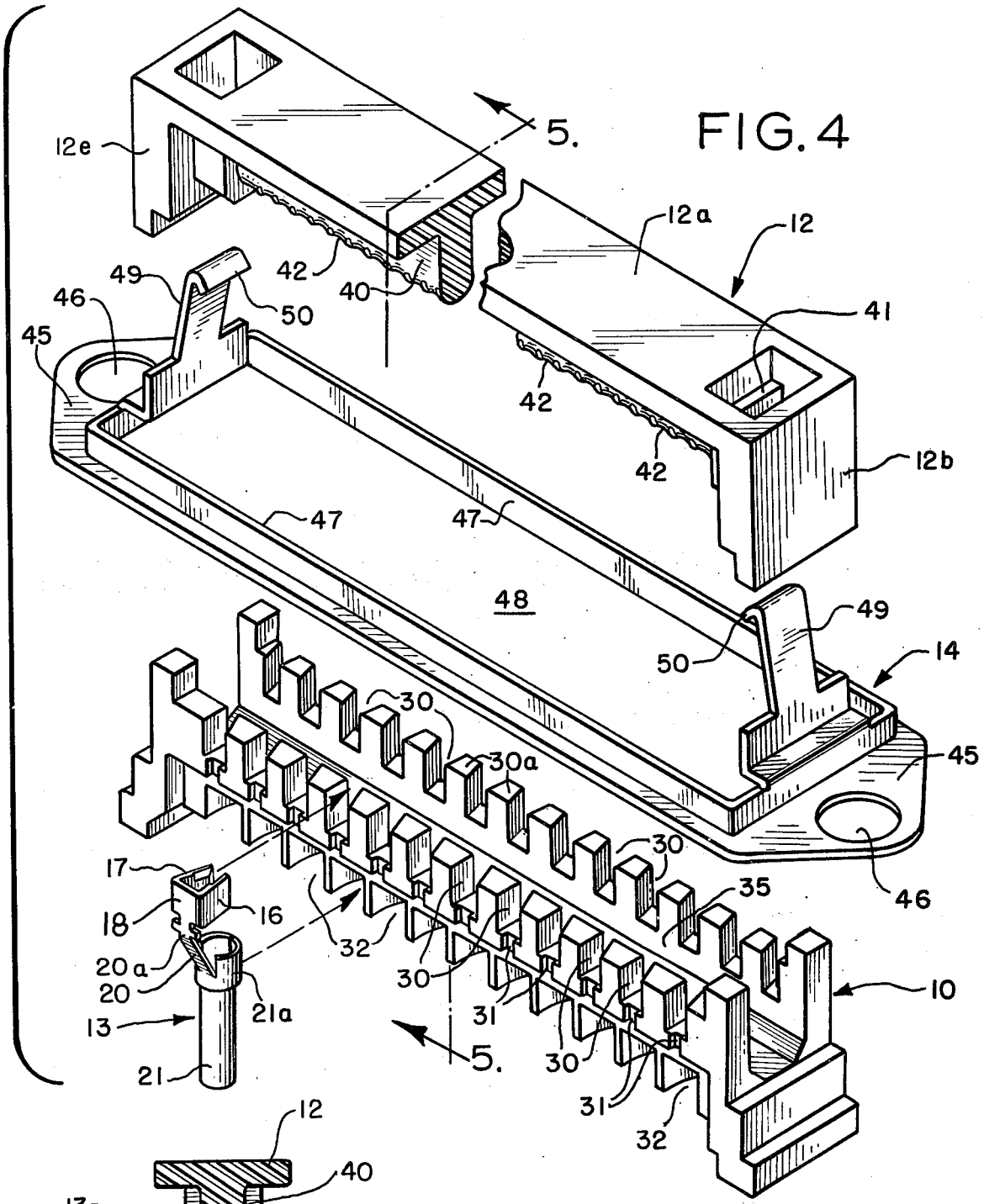
FIG. 4 is an exploded perspective view, partly cut away, showing the component parts of a first portion of the connector of FIG. 1.
Figure 6:
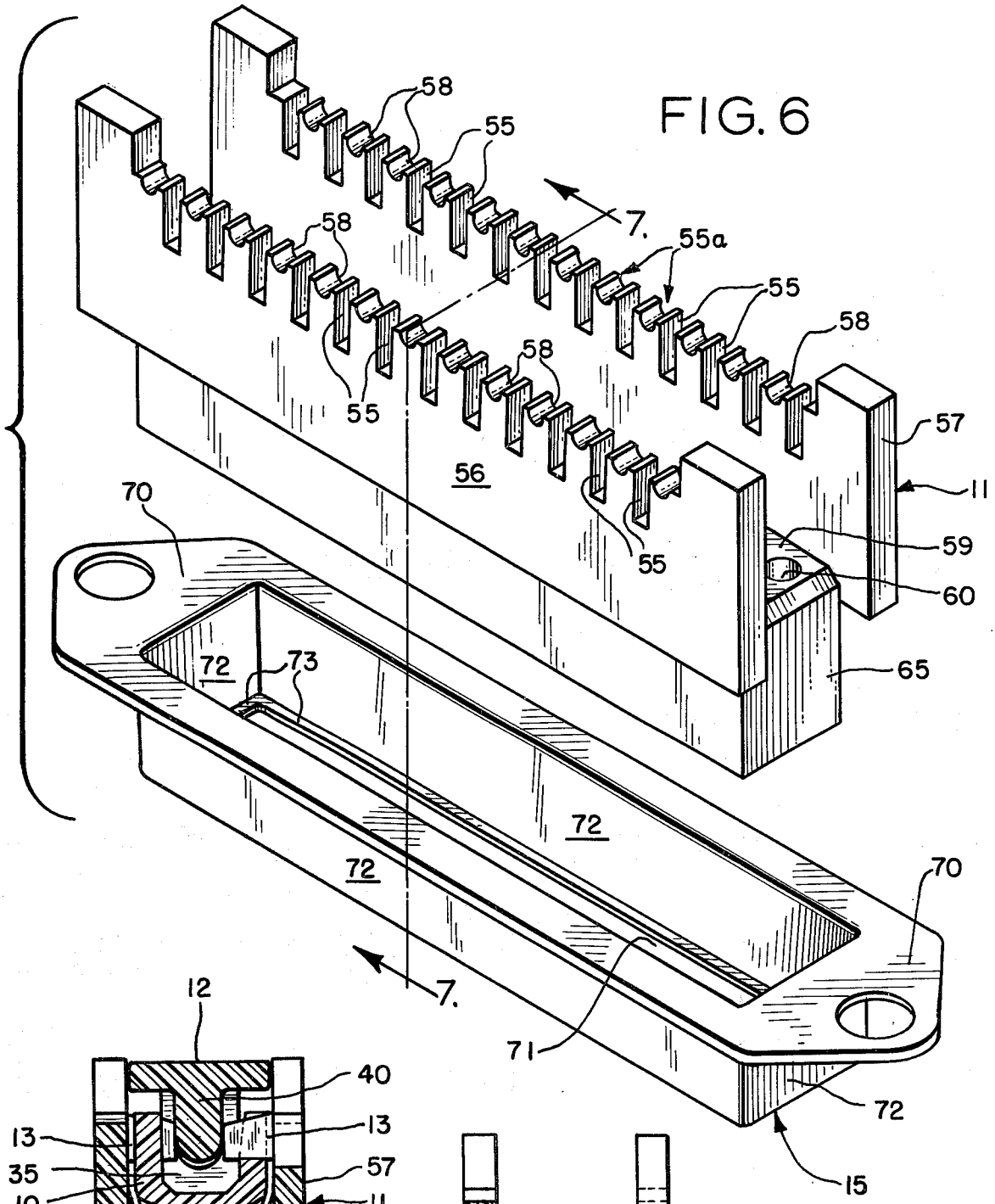
FIG. 6 is an exploded perspective view of the component parts of a second portion of the connector of FIG. 1.

Referring now to the Figures, and more particularly to the exploded views of FIGS. 4 and 6, the connector of the present invention there illustrated includes a body comprising an inner body portion 10, an outer body portion 11, a top cover 12, contact means composed of a plurality of like contact elements, an exemplary contact being shown at 13, and a clamp for holding the connector together including a first clamp portion 14 and a second clamp portion 15.

Each contact 13 has a generally U-shaped configuration including a pair of opposed sides or jaw members 16 and 17 which project in a common direction from a transverse base or bight portion 18 and which are formed so as to converge toward one another. As will be more fully developed later, the jaws 16 and 17 are arranged to act as spring-like beams in close juxtaposition and partially biased against each other and to extend substantially parallel to the axis of the insulated conductor engaged therebetween.

The contact 13 further includes an extension comprising a straight portion 20 depending from the bight portion 18. A cylindrical portion 21 to be described in greater detail later herein forms the lower extent of the contact 13.

The inner body portion 10 (FIG. 4) is of a generally rectangular configuration and includes a plurality of cut-out portions or slots 30 formed intermediate a series of vertically aligned wall portions or teeth **30*a* of trepezoidal cross-section. The slots 30 defined by the teeth 30*a* are dimensioned for receiving the converging sidewalls 16 and 17 of the contacts 13. The walls of the teeth 30*a* which define the slots 30 provide support for the jaws 16 and 17 and prevent them from collapsing or deforming during the process of piercing and stripping the insulation of the conductor 80 and electrically engaging the contact 13 with the conductor 82, as described in greater detail below. In addition, the slots 30 and the complementary teeth 30*a* are preferably arranged in a pair of parallel laterally spaced-apart rows with the slots 30 of one row being staggered relative to the slots 30 of the opposite row. As a result, each slot of one row is directly facing a tooth 30*a*** between adjacent slots of the opposite row.

Aligned with and immediately below each slot 30 of the inner body portion 10 is a first minor recess 31 for receiving an initial segment **20*a* of the straight extension portion 20 of the contact 13. In a similar manner, the inner body portion 10 further includes a plurality of second recesses 32 each disposed immediately below a transverse indexing shelf of an associated minor recess 31 and having arcuate inner walls for mateably receiving an enlarged top segment 21*a* of the cylindrical extension portion 21**.

As a result of the above construction, each contact is received by one of the slots 30 and associated recesses 31, 32 for indexing and holding the contact in place. As an example, the contact 13 shown in FIG. 4 is to be received by the associated slot 30, the minor recess 31, and the arcuate recess 32, in the manner indicated by the arrow in the drawing for indexing and retaining the contact 13 in place.

Between the laterally spaced rows of teeth **30*a* is a channel-like cavity 35 extending the full length of the body member 10. The cavity 35 is perpendicular to the direction of insertion of the contacts 13 into the body 10 and, as well be more fully explained hereinafter, the cavity extends transversely to the parallel conductors 80** of the flat cable to be contacted.

The cover portion 12 of the connector includes a planar top plate **12*a* and depending end portions 12*b*, 12*c*, which are adapted to interfit with the first clamp portion 14. An elongated bar member 40 of generally U-shaped cross-section depends from the underside of the top plate 12*a* and is dimensioned to be received within the elongated cavity 35 of inner body portion 10. The elongated bar 40 includes a plurality of inward arcuate cam surfaces 42 formed intermediate a series of uniformly spaced ribs 43 which serve to align each conductor of the plurality of parallel conductors with a respective given one of the contacts 13 within the inner body portion 10. The cover 12 also includes internally of the depending end portions 12*b* and 12*c* respective shoulders 41 (FIGS. 2 and 4), each of which cooperate in a like manner with respective latch elements of the first clamp portion 14 for locking the cover 12 onto the inner body portion 10**.

Figure 1:
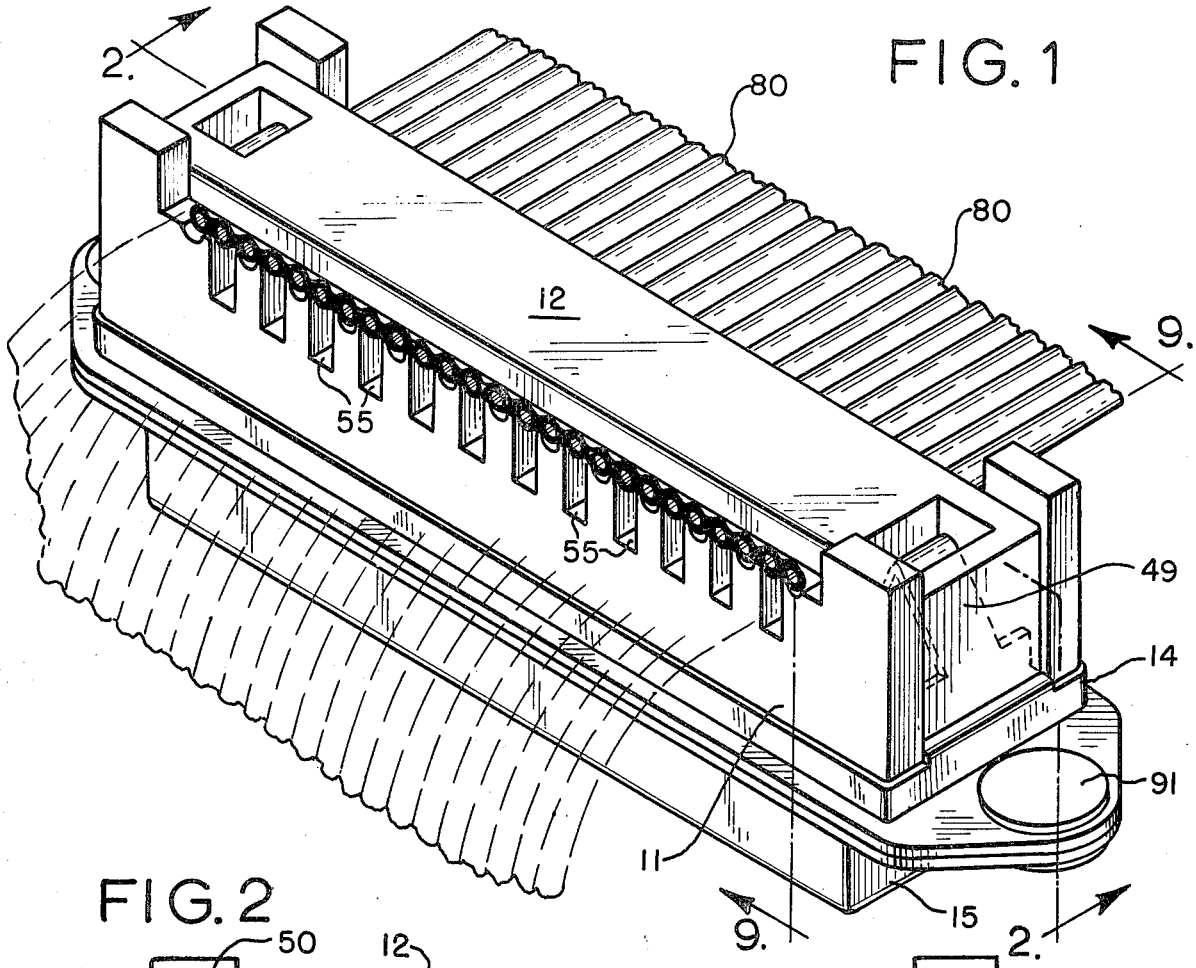
FIG. 1 is a perspective view of a connector embodying the present invention.
Figure 2:
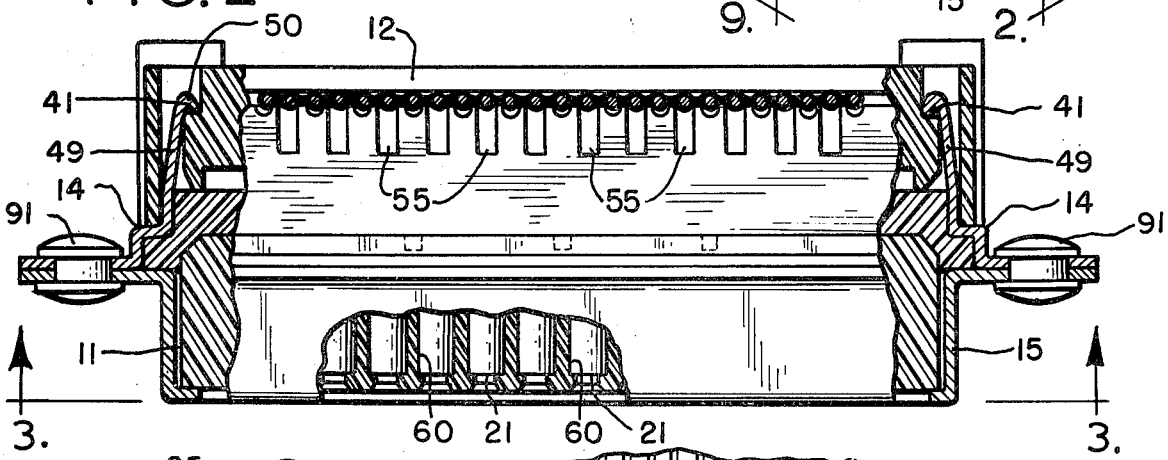
FIG. 2 is a side elevational view, partly in cross-section, taken substantially along lines 2—2 of FIG. 1.
Figure 3:
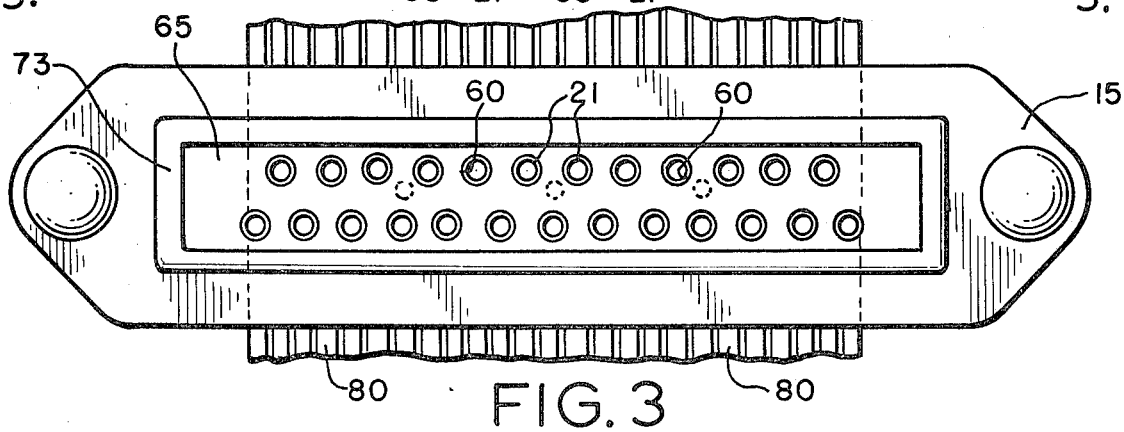
FIG. 3 is a bottom plan view of the connector of FIG. 1 as viewed from line 3—3 of FIG. 2.
Figure 5:
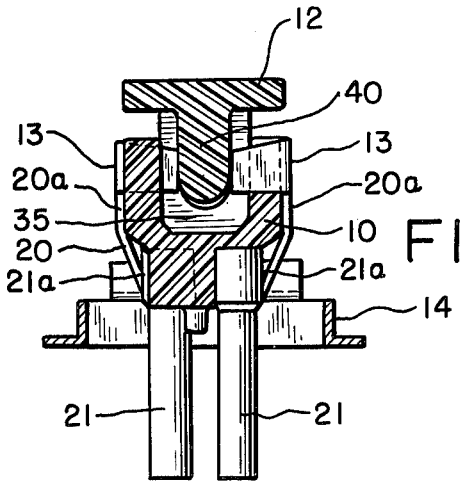
FIG. 5 is a cross-sectional view taken substantially along line 5—5 of FIG. 4 showing the component parts of the first portion assembled.

The first clamp portion 14 includes a planar base plate 45 of generally rectangular outline having at each end an integral triangular tab in which there is formed an opening 46 for a fastener 51 (FIGS. 1–3). An upstanding flange 47 defines the periphery of a central opening 48 of rectangular outline which is dimensioned for snugly receiving the outer body portion 11 (FIG. 6). The first clamp portion 14 also includes a pair of upstanding latch members 49 integrally formed with the clamp at opposite ends of the elongate opening 48. The like latch members 49 are biased inwardly and terminate in reverse hook portions 50 which snap-lock over the shoulder portions 41 of the cover 12 to facilitate locking the cover 12 in place. The interrelation of the several components of FIG. 4 in their assembled state prior to installation of the insulated conductor may be appreciated by reference to FIG. 5 which is a cross-sectional view of the inner body portion 10, the first clamp portion 14, the cover 12, and the contact 13.

It should be noted that each latch member 49 includes a horizontal shoulder 52 which acts as a stop for the bottom ends of the depending end portions **12*b* and 12*c* of the cover 12. This arrangement limits the maximum distance which a bar member 40 may be inserted within the cavity 35 of the inner body portion 10 and thereby limits the extent of movement of the conductor 80 produced by the insertion of the bar member 40**, as described in greater detail below.

Referring now to FIG. 6, there is illustrated the outer body portion 11 and the second clamp portion 15 of the connector body which are adapted to interfit with their counterpart components of FIG. 4. The outer body portion 11 includes parallel sidewalls 56 and 57 which are carried on opposite sides of an elongate block 65 so as to project substantially above the top surface 59 of the block 65. The sidewalls 56 and 57 are spaced apart to form an elongate channel which enables the inner body portion 10 of FIG. 4 to be received in the space between the sidewalls 56 and 57 when the connector body is assembled. The sidewalls 56 and 57 of the outer body portion 11 each include a plurality of like cut-out portions or slots 55 forming a series of upstanding teeth or wall portions **55*a* within the respective sidewalls 56 and 57. The slots 55 are arranged to be aligned with the inner body portion slots 30 when the connector components are assembled. As a result, the slots 55 provide external access to each contact to facilitate external testing, as may be appreciated by reference to the illustration of the fully assembled connector of FIG. 1. Within the individual teeth 55*a* of the outer walls 56 and 57 are cut-out portions 58 which have concave arcuatelyshaped bottom surfaces. The cut-out portions 58 have a width dimension generally corresponding to that of the insulated conductors so as to provide assistance in aligning the parallel insulated conductors across the connector, and the arcuately-shaped bottom surfaces of the cut-out portions 58** are adapted to receive individual insulated conductors. As a result, the connector of the present invention can accommodate a plurality of individual insulated conductors in addition to flat wire cables of the type previously described.

Figure 7:
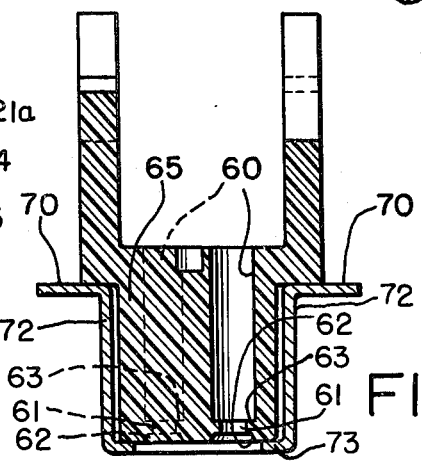
FIG. 7 is a cross-sectional view taken substantially along line 7—7 of FIG. 6 showing the component parts of the second portion assembled.

The top surface 59 of the central block 65 of the outer body portion 11 further includes a plurality of vertical bores or channels 60 therein (FIG. 3) of generally cylindrical cross-section and formed in two parallel rows for receiving the cylindrical extensions 21 of the contacts 13 when the contacts 13 are properly aligned in the outer body portion 11. The channels 60 extend at a constant diameter nearly the full depth of the outer body portion 11 as best seen in FIG. 7. The channels 60 terminate at the lower surface of the block 65 in a pair of co-axially aligned counter bores 61 and 62 with the narrowed counter bore 61 forming a transitional shoulder 63 near the lower surface of the block 65. The enlarged top segment **21*a* of the cylindrical portion 21 seats against the block top surface 59 as shown for example in FIG. 8. The narrowed channels 61 terminate in the flared counter bores 62 formed in the lower surface of the block 65. The counter bores 61, 62 enable communication with the cylindrical extension portions 21 of the contacts 13 when they are positioned within the channels 60. As a result, the cylindrical portions 21 of the contact extensions will terminate in close proximity to the end of the channels 60 so that the contacts may receive external terminals carried by a modularized printed circuit board of mating connector. The external terminals (not shown), of course, must be complementary to cylindrical portions 21** for mating engagement therewith.

The second clamp portion 15 as seen in FIG. 6 includes a base 69 having an upper outer peripheral flange 70 disposed about a central, rectangular receiving well 71 formed by four depending sidewalls 72 and a peripheral lower inner flange 73. The sidewalls 72 and the flange 73 are dimensioned for seating the block 65 of the outer body portion 11, as may be clearly seen in FIG. 7 which is a cross-sectional view showing the components 11, 15 of FIG. 6 in their assembled relation. Furthermore, an opening 74 is disposed at each end of the flange 70 for receiving a fastener 51 (FIGS. 1–3).

Figure 8:
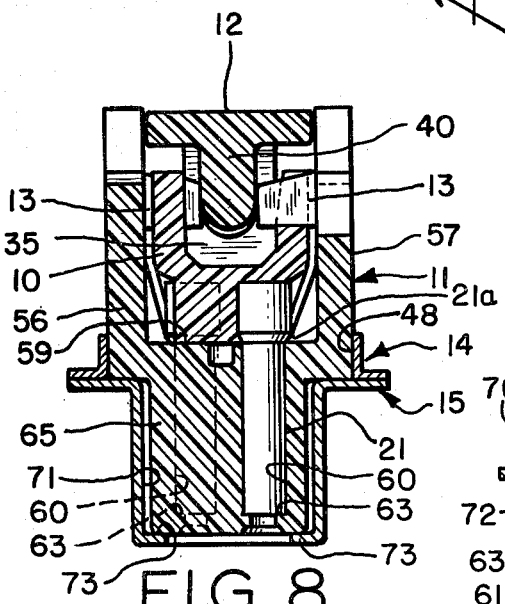
FIG. 8 is a cross-sectional view showing the connector of FIG. 1 fully assembled.

The assembled relation of the components 11, 15 of FIG. 7 with the remaining connector components, namely, the inner body portion 10, the contacts 13, the clamp 14 and the cover 12, may be appreciated by reference to FIG. 8 which is a cross-sectional view of the connector fully assembled.

As can be seen, the inner body portion 10 and the contacts 13 are received within the outer body portion 11 between the sidewalls 56, 57 with the cylindrical extensions 21 of the contacts 13 seating against the top surface 59 of the block 65. The inner body portion 10 and the outer body portion 11 subassembly is then encapsulated by the clamp portions 14, 15. As can be seen, the block 65 of the outer body portion 11 is seated in the opening 71 formed by the four sidewalls 72 of the second clamp portion 15 with the outer body portions 11 resting on the top surface of the flange 70 of the base 69. The first clamp portion 14 is received over the outer body portion 11 so that its peripheral flange 45 abuts and aligns with the like contoured flange 70 of the second clamp portion 15. The plate **12*a* of the top cover 12 is received by the outer body portion 11 between the sidewalls 56 and 57 with the elongated bar member 40 extending into the cavity 35**.

Referring now to FIGS. 9 through 13, and in accordance with a principal aspect of the present invention, each contact 13 includes a pair of closely juxtaposed, gradually converging, and partially biased jaw or beam members 16 and 17 as previously described. Each jaw 16 and 17 includes a piercing portion 90 having upper component piercing and stripping portions **90*a* and 90*b* along its upper surface and forward surface, respectively, and a lower contact portion 92 located below and rearwardly of the associated forward piercing portion 90*b*, and where the jaws 16 and 17 meet. The contact portions 92 of the jaws 16 and 17 are preferably biased against each other so as to produce positive contact with the conductor 82 as more fully described below. The jaws 16 and 17 above the contact portions 92** are generally shaped in the form of an outwardly flared "V".

The opposed piercing portions **90*a* include inward facing stripping portions 91 which are beveled to extend at an angle away from the contact portions 92 and define narrow upper cutting edges 93. The edges 93 of each contact 13 are preferably spaced apart a distance just slightly greater than the diameter of the conductor wire 82 but less than the diameter of the insulated conductor 80. The opposed piercing portions 90***b* are partially aligned with the contact portions 92 and include inward beveled stripping portions 94 which are oriented angularly adjacent beveled stripping portions 91 and which define narrow forward cutting edges 95. The junction between each upper cutting edge 93 and a forward cutting edge 95 defines a piercing point 96. In a preferred form and as particularly illustrated in FIGS. 12 and 13, the cutting edges 93 and 95 face away from rather than toward the contact portions 92 of the contact 13. This is quite different from that of prior insulation-piercing contact arrangements.

As particularly illustrated in FIGS. 9–9*b*, 12 and 13, when the parallel conductors 80 are initially aligned with and inserted into the contacts 13, the insulation 81 is arranged relative to the piercing portions 90*a* and 90*b* such that it will be first engaged by the piercing and stripping portions 90*a* substantially parallel and immediately adjacent to the conductor 82. After each conductor 80 is initially aligned, it is then forced downwardly by the downward movement of the bar member 40 in an arcuate path relative to the piercing portions 90 as indicated by the arrows 97 and 98. The shoulders 52 (FIG. 1) limit the total movement of the conductors 80. As the conductor 80 is so moved, the insulation 81 is first pierced by the piercing points 96 and then continuously cut and partially stripped away or spread in opposing directions from the initially pierced area by the cutting edges 93 and 95. As can be clearly seen from FIG. 9*b*, the insulation 81 is cut along the conductor 82 at an angle relative to the central axis thereof as the insulated conductor 80 is drawn angularly across the cutting edges 93 and 95.

As the conductor 80 is gradually cut and partially stripped by the cutting edges 93 and 95, it is also subsequently forced angularly across and down against the beveled edges 91 and 94 toward the contact portions 92. As this occurs, the beveled edges 91 and 94 firmly restrain further movement of the cut insulation 81 in opposition to the continued downward arcuate movement of the conductor wire 82. This causes the beveled edges 91 and 94 to spread and strip away the remainder of the insulation 81 from the opposite sides of the conductor wire 82 while the stripped conductor wire 82 simultaneously initiates the separation of the biased opposing contact portions 92 as more fully described below. This action of the beveled edges 91 and 94 against the conductor 80 exposes a broad longitudinal surface area 82*a* on the conductor wire 82 parallel to the axis of and on the opposite sides of the conductor 80. It should also be noted that in certain instances, such as when the diameter of the conductor 82 is small relative to the distance between the jaws 16 and 17, the lower inner side edges of the beveled surfaces 91 and 94 may also be involved in the stripping of the insulation 81.

As mentioned above, the downward arcuate movement of the conductor 80 across the beveled edges 91 and 94 initiates separation of the biased contact portions 92. As the conductor 80 is pushed further into the contact 13 by the downward movement of the bar member 40, the exposed surface areas 82*a* on the opposite sides of the conductor wire 82 are gradually forced into the closed slit between the contact portions 92 which represent the opposing biased portions of the jaws 16 and 17. Thus, the downward force of the bar member 40 against the conductor 80 overcomes the bias force between the opposed contact portions 92 of each contact 13 and forces the conductor wire 82 to open the slit between the contact portions 92. In this manner, the converging jaws 16 and 17 forming the contact portions 92 exert a force normal to the exposed surface areas 82*a* of the conductor wire 82 for making broad intimate surface contact with the conductor wire 82. This broad surface contact not only assures that the conductor 80 is resiliently held by the contact portions 92 of the jaws 16 and 17, but it also provides a low resistance electrical connection between the conductor wire 82 and the contact 13.

Figure 14:
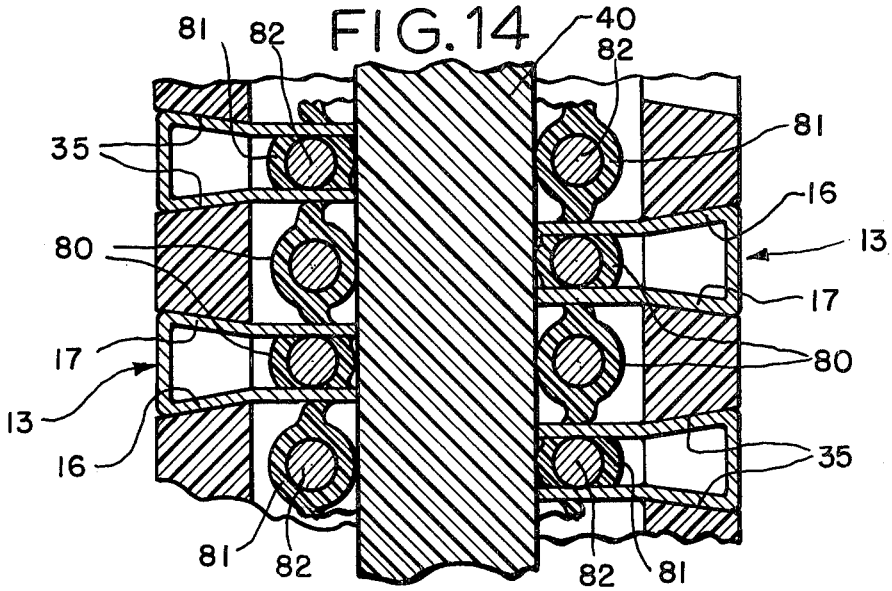
FIG. 14 is a cross-sectional view taken substantially along lines 14—14 of FIG. 9.

It should also be noted that the contact jaws 16 and 17 are of sufficient size to completely pierce through the insulation as best seen in FIG. 14. Thus, the conductor 80 is firmly held in place while electrically engaged by the contact 13. Furthermore, and for the purpose of example only, representative dimensions of a contact element 13 for use with a conductor wire 82 of 0.010–0.013 inch in diameter are as follows: the distance between adjoining wires 82 in a flat cable is about 0.037 inch with 0.032 inch between piercing points 96 of adjoining elements 13; the distance between piercing points 96 for a single element 13 is about 0.012 inch; and the metal thickness of jaws 16 and 17 is about 0.010–0.011 inch.

As also seen in FIG. 10, the cylindrical extension 21 includes a longitudinal slot 100 so that the cylindrical portions may be resiliently expanded when receiving a mating external contact. As a result, a mating contact will exert a force against the inner walls of the contact cylinder portions 21 to secure the external connections.

FIGS. 1 through 3 show the connector in its assembled state with a flat cable composed of a plurality of parallel insulated conductors 80. In assembling the connector, the contacts 13 are inserted into the slots 30 and the recesses 31 and 32 of the inner body portion 10. The cylindrical extensions 21 of the contacts are then inserted into the channels 60 of the outer body portion 11, and the outer body portion 11 and the inner body portion 10 are thereafter press-fit together. Thereafter, the outer body portion 11 is inserted into the clamp 15, and the clamp portion 14 is received over the outer body portion 11. A suitable means such as the fasteners or rivets 51 may be installed in the contiguous openings 46, 74 in the end tabs of the clamps 14, 51 for securing the first and second clamp portions together.

Figure 9A:
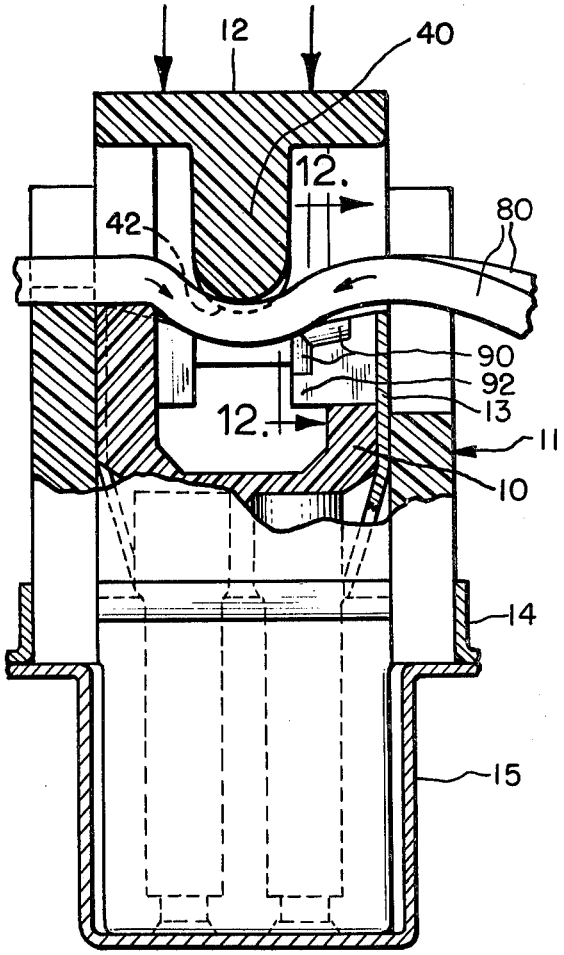
FIG. 9*a* is a partial cross-sectional side view of the connector of FIG. 1 illustrating the positioned relation of the connector and conductor during an initial step in assembly just prior to the engagement of a conductor with the connector contacts.
Figure 9B:
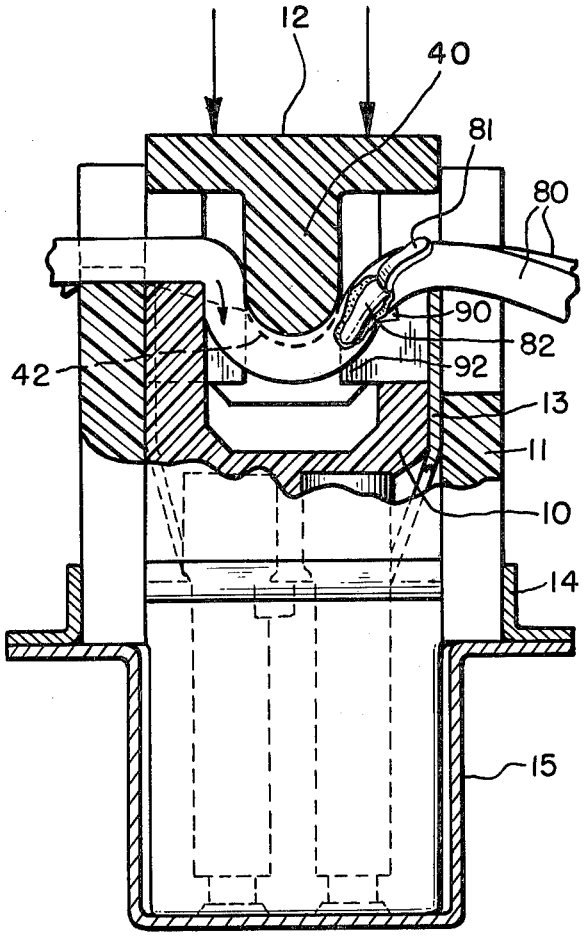
FIG. 9*b* is a partial cross-sectional view of the connector of FIG. 1 at a later step in assembly showing the connecto after the conductors have partially engaged the connector contacts.

When the connector is to contact the plurality of parallel insulated conductors 80, the plurality of conductors are disposed across the connector as shown in FIG. 9*a* so that the insulated conductors extend transversely to the cavity 35 of the inner body portion 10. The cover 12 is then brought into engagement with the insulated conductors so that the arcuate cam surfaces 42 of the bar member 40 engage and align the conductors 80 with the contacts 13. As shown in FIG. 9*b*, the cover 12 is then pressed downwardly in the direction of the arrow 99 in the Figure so that the bar member 40 forces the insulated conductors 80 into the cavity 35. As the bar member 40 pushes the insulated conductors 80 into engagement with the contacts 13, the insulation 81 on opposite sides of each conductor wire 82 is pierced and continuously stripped by the piercing portions 90*a* and 90*b* of the contacts 13 substantially parallel to and immediately adjacent longitudinal portions of the conductor wires 82 to expose a broad surface of the conductor wire 82 as previously described. Because each contact 13 includes two sides, each having a piercing portion 90 with component piercing portions 90a and 90b, a broad surface area is exposed on opposite sides of each conductor wire 82.

After the conductors engage the piercing portions 90a and 90b, they engage the contact portions 92 which exert a force against the conductors in a direction normal to the conductors for making broad intimate flat surface contact with the exposed areas of the connectors. FIG. 9 shows the conductors in their substantially fully engaged position relative to the contacts 13. Of course, because each conductor wire 82 is engaged on opposite sides, as shown in FIG. 14, the conductor receives broad intimate flat surface contact at two separate locations. Hence, a low resistance contact for each conductor is assured.

When the cover 12 is properly installed as shown in FIGS. 1 and 9, the latch members 49 of the first clamp portion 14 slide over the shoulders 41 of the connector cover 12 to snap-lock the cover 12 onto the connector and thereby provide a positive indication that the cover is properly seated. Moreover, because the cover is snap-locked in place, the bar member 40 serves to provide strain relief to the conductors without requiring additional hardware for providing that function. Additionally, the cover 12 serves to protectively enclose the contacts.

FIG. 3 shows the bottom of the connector of FIG. 1 and particularly shows the channels 60 which extend through the block portion 65 of the outer body portion 11. Also shown in FIG. 3 are the cylindrical contact extensions 21 for receiving complementary external terminals from a printed circuit board or the like for connecting the printed circuit or connector to the contacts and thus to the conductors.

Of course, the connector of the invention may be preassembled except for the engagement of the cover 12 and the permanent fastening of the first and second clamp portions 14 and 15 respectively by the rivet 51 or similar means. As can be clearly seen, the connector of the present invention includes a minimum number of individual parts to render assembly of the connector substantially more convenient than competitive prior art connectors. Additionally, as previously indicated, no external parts are required for providing strain relief to the conductors and indeed strain relief is inherently provided upon proper assembly of the components. As a result, the connector of the present invention is substantially more convenient to use than prior art connectors. Lastly, because the contacts pierce and strip the conductor insulation substantially parallel to the axes of the conductors and the contact portions exert a force normal to the conductors after they have been pierced and stripped, the contacts are assured of making a broad intimate surface contact with the conductors thereby to provide a low resistance electrical path between the contacts and the conductors.

While a particular embodiment of the present invention has been shown and described, modifications may be made, and it is intended in the appended claims to cover all such modifications that fall within the true spirit and scope of the invention.

I claim:

1. A connector for making intimate electrical contact with an insulated conductor having a longitudinal axis comprising:

contact means including at least one contact element, each said contact element including a pair of oppositely disposed members for piercing and stripping a longitudinal portion of the insulation from opposite sides of said conductor, each said longitudinal portion having a broad longitudinal surface area relative to the diameter of said conductor, and a conductor contact portion extending substantially parallel to the axis of said longitudinal portions when said conductor is engaged therewith, each said piercing and stripping member of each said contact element including first and second elongate component portions longitudinally aligned at an angle relative to each other, each said component portion having elongate cutting means defined by beveled surface means; and means for moving said insulated conductor into successive engagement with said piercing and stripping members and said contact portion of said contact element for first piercing and continuously stripping the insulation along said opposing longitudinal portions of said conductor and for thereafter positioning said longitudinal conductor portions adjacent said contact portion, said contact portion being adapted to exert a force against said longitudinal conductor portions in a direction normal to the conductor to effect a broad intimate flat surface contact therewith.

2. A connector for making intimate electrical contact with an insulated conductor comprising:

contact means including at least one contact element having a pair of spaced-apart converging jaw members, each of said jaw members including an insulation piercing and stripping portion and a conductor contact portion, said jaw members being arranged to engage and strip the insulation immediately adjacent opposite sides of the conductor along longitudinal portions thereof, each said stripped longitudinal portion having a broad longitudinal surface area relative to the diameter of said conductor, each said piercing and stripping portion of each said jaw member including first and second elongate component portions aligned at an angle relative to each other, each said component portion having elongate cutting means defined by beveled surface means; and means for moving the insulated conductor into successive engagement with said insulation piercing and stripping portions and said conductor contact portions for first piercing and continuously stripping the insulation substantially parallel to and immediately adjacent opposite sides of said longitudinal portions of said conductor and for thereafter forcing said longitudinal conductor portions between said contact portions which exert a force against said longitudinal portions in a direction normal to the conductor for making broad intimate flat surface contact on opposite sides thereof.

3. The connector of claim 2 in which said contact element further includes a base portion, and wherein said jaw members extend from said base portion in a common direction and converge against each other.

4. The connector of claim 2 in which each said first component portion includes a first beveled stripping surface extending at an angle upwardly and outwardly away from said contact portion to define an upper elongate cutting edge at the end thereof, said upper cutting edge being aligned substantially parallel to said conductor immediately prior to moving said conductor into said successive engagement with said insulation piercing and stripping portions and said conductor contact portions, and each said second component portion includes a second beveled stripping surface extending forwardly and outwardly away from said contact portion and being angularly aligned relative to said first beveled stripping surface, said second beveled stripping surface defining a forward elongate cutting edge at the end thereof which is aligned angularly adjacent to said upper cutting edge to define a piercing point at the junction thereof.

5. The connector as described in claim 2, wherein said moving means is further adapted to move said insulated conductor down on said piercing means and across said jaw members to pierce and strip said insulation.

6. The connector as described in claim 5, wherein said connector further includes stop means for limiting the downward movement of said moving means.

7. The connector as described in claim 2, wherein said connector further comprises means for supporting said at least one contact element and means for aligning said conductor with said at least one contact element.

8. The connector as described in claim 7, wherein said supporting means comprises an insert member including means for supporting said jaw members from substantial downward movement during downward movement of said conductor into engagement with one said contact element.

9. The connector as described in claim 7, wherein said alignment means comprises means for positioning portions of said conductor angularly across said jaw members.

10. A connector for making intimate contact with each of a plurality of parallel insulated conductors, said connector comprising:

contact means including a plurality of contact elements each having a pair of spaced-apart jaws extending substantially parallel to the center axes of the conductors with each said jaw having an insulation piercing and stripping portion and a conductor contact portion, each said piercing and stripping portion of each said jaw including first and second elongate component portions longitudinally aligned at an angle relative to each other, each said component portion having elongate cutting means defined by beveled surface means body means including a first body portion for indexing and holding said contact elements in predetermined relative positions; and means for moving the insulated conductors into successive engagement with said insulation piercing and stripping portions and said conductor contact portions for first piercing and continuously stripping the insulation substantially parallel to and immediately adjacent a longitudinal portion of each side of each conductor, each said longitudinal portion having a broad longitudinal surface area relative to the diameter of its respective conductor, and for thereafter forcing said stripped longitudinal conductor portions between said contact portions which exert a force against said stripped longitudinal conductor portions in a direction normal to the conductors for making broad intimate flat surface contact therewith.

11. The connector of claim 10 in which said first body portion includes a plurality of slots for indexing and holding said contacts.

12. The connector of claim 11 in which each of said contact elements includes an extension member, wherein said connector further includes a second body portion having channel means, and wherein said contact element extension members project into said channel means.

13. The connector of claim 12 in which said channel means comprises a plurality of channels corresponding in number to said contact elements for receiving said contact element extension members.

14. The connector of claim 13 in which said channels extend through said second body portion and in which said contact element extension members terminate in proximity to the ends of said channels for providing external access to said contact elements.

15. The connector of claim 14 in which said contact element extension members include substantially cylindrical portions in which said channels are substantially cylindrical and dimensioned for receiving said contact cylindrical portions, and in which said contact cylindrical portions form terminals adapted for securely mating with complementary external terminals.

16. The connector of claim 11 in which said plurality of slots are arranged in a pair of laterally spaced rows.

17. The connector of claim 16 in which said first body portion includes a cavity between said laterally spaced rows of slots.

18. The connector of claim 17 in which said slots in each of said rows are spaced one from the other by uniform distances and in which said slots in one row are offset relative to said slots in the other row.

19. The connector of claim 17 and further including a second body portion adapted for interfitting with said first body portion and having spaced-apart rows of slots aligned with said slots of said first body portion when said first and second body portions are assembled in said interfitting relation.

20. The connector of claim 19 in which said first body portion comprises an inner body portion and wherein said second body portion comprises an outer body portion having a cavity for receiving said inner body portion therein.

21. The connector of claim 17 in which said contact elements each include a base portion and wherein said jaws extend from said base portions in a common direction, said jaws converging against each other as they extend in said common direction to form said conductor contact portion.

22. The connector of claim 21 in which each said first component portion includes a first beveled stripping surface extending at an angle upwardly and outwardly away from said contact portion to define an upper elongate cutting edge at the end thereof, said upper cutting edge being aligned substantially parallel to said conductor immediately prior to moving said conductor into said successive engagement with said insulation piercing and stripping portions and said conductor contact portions, and each said second component portion includes a second beveled stripping surface extending forwardly and outwardly away from said contact portion and being angularly aligned relative to said first beveled stripping surface, said second beveled stripping surface defining a forward elongate cutting edge at the end thereof which is aligned angularly adjacent to said upper cutting edge to define a piercing point at the junction thereof.

23. The connector of claim 22 in which said contacts are received by said slots with said jaws extending toward said cavity, the walls of said slots providing support for and preventing deformation of said jaws when said conductor is engaged with said contact element.

24. The connector of claim 17 in which said connector is adapted for aligning the plurality of parallel insulated conductors across the top of said body means with the insulated conductors extending transverse to said cavity with respective ones of said insulated parallel conductors being aligned between the sides of respective ones of said contact elements, and wherein said moving means is adapted to force the parallel insulated conductors into said cavity for engaging said contact elements.

25. The connector of claim 24 in which said moving means includes a bar member dimensioned for being received by said cavity.

26. The connector of claim 25 and further including a cover portion for protecting said contact elements and in which said bar member is carried by said cover portion.

27. The connector of claim 26 further including lock means for latching said cover portion to said body means when said cover portion is forced into said cavity sufficiently to effect secure engagement of the conductors with said contact elements, whereby with said cover portion latched to said body said cover serves to protect said contact elements and provide strain relief for the conductors.

28. A connector for making intimate electrical contact with each of a plurality of parallel insulated conductors, said connector comprising:

contact means comprising a plurality of contact elements each having a pair of spaced-apart jaw members extending substantially parallel to the center axes of the conductors, each said jaw member having an insulation piercing and stripping portion arranged to engage and strip the insulation immediately adjacent the conductors and a conductor contact portion for effecting electrical contact with said stripped conductor, each said piercing and stripping portion of each said jaw member having first and second elongate component portions aligned at an angle relative to each other, each said component portion including elongate cutting means defined by beveled surface means, said contact elements also including extension portions;

an inner body portion including a pair of spaced-apart rows of slots for indexing and holding said contact elements in predetermined positions and arranged to align respective ones of said contact elements with respective ones of said conductors, said inner body portion being formed for including a cavity extending between said spaced-apart rows of slots;

an outer body portion for receiving said inner body portion in a mated interfitting relation and including a plurality of sots aligned with said inner body slots, said outer body portion also including a floor having a plurality of channels projecting therethrough for receiving said contact extension portions to provide means for external access to and testing of each said contact elements;

cover means for protectively enclosing said contact elements and including a bar member dimensioned to be received by said cavity; and locking means for securing said cover portion to said inner and outer body portions when said cover means bar member is properly positioned within said cavity, said bar member of said cover means being constructed and arranged for forcing the parallel insulated conductors transversely into said cavity and into engagement with said contact elements for causing each of said piercing portions to pierce and partially strip the insulation substantially parallel and immediately adjacent to the axes of respective ones of said conductors along opposite longitudinal portions of each said conductor, each said stripped longitudinal portion having a broad longitudinal surface area greater than the diameter of said conductor, and for forcing said longitudinal conductor portions adjacent said contact portions which exert a force normal to the axes of respective ones of said longitudinal portions for making broad and intimate surface contact therewith when said cover portion is locked in place.

29. An electrical contact element comprising base means and a pair of opposed, transversely disposed jaw members projecting from said base means for receiving an elongated insulation covered conductor therebetween, said jaw members defining an upwardly opening and a forwardly opening entrance portion relative to said base means for piercing and stripping said insulation said jaw members converging toward each other from said upwardly opening entrance portion to terminate in a conductor contact portion wherein said pair of jaw members are in at least close juxtaposition, said upwardly opening and forwardly opening entrance portion including means for piercing and stripping said insulation along the axis and from a longitudinal portion of opposite sides of said conductor as said conductor is moved arcuately downwardly between said jaw members to reach a position between said contact portions, each said stripped longitudinal portion on each side of said conductor having a broad longitudinal surface area relative to the diameter of said conductor, the contact portions of said jaw members being adapted to be separated by said conductor and to receive the stripped longitudinal conductor portions therebetween and exert a force thereagainst in a direction normal to the conductor to effect a broad intimate flat surface contact therewith.

30. The electrical contact element as described in claim 29, wherein each said jaw member includes said means for piercing and stripping said insulation, and wherein said insulation piercing and stripping means of each said jaw member comprises a first beveled stripping surface on the inner surface of said jaw member which extends at an angle upwardly and outwardly away from said contact portion relative to said base means to define an upper elongate cutting edge at the end thereof, said upper cutting edge being aligned substantially parallel to said conductor immediately prior to moving said conductor arcuately downwardly between said jaw members, and a second beveled stripping surface on the inner surface of said jaw which extends forwardly and outwardly away from said contact portion relative to said base portion and is angularly aligned relative to said first beveled stripping surface, said second beveled stripping surface defining a forward elongate cutting edge at the end thereof which is aligned angularly adjacent to said first beveled stripping surface to define a piercing point at the junction thereof.

* * * * *